US008684178B1

(12) United States Patent
Solomon

(10) Patent No.: US 8,684,178 B1
(45) Date of Patent: Apr. 1, 2014

(54) STORAGE AND DISPENSING SYSTEM

(76) Inventor: Elias E. Solomon, Duxbury, MA (US)

( * ) Notice: Subject to any disclaimer, the term of this patent is extended or adjusted under 35 U.S.C. 154(b) by 0 days.

(21) Appl. No.: 13/558,097

(22) Filed: Jul. 25, 2012

Related U.S. Application Data

(60) Provisional application No. 61/512,479, filed on Jul. 28, 2011.

(51) Int. Cl.
*B65D 85/00* (2006.01)
*B65H 57/18* (2006.01)

(52) U.S. Cl.
USPC ..... 206/408; 206/409; 242/171

(58) Field of Classification Search
USPC ..... 206/389, 397, 408, 409; 242/137.1, 242/170, 172; 385/135
See application file for complete search history.

(56) References Cited

U.S. PATENT DOCUMENTS

| | | | | |
|---|---|---|---|---|
| 2,753,042 | A * | 7/1956 | Wellcome | 206/397 |
| 4,159,795 | A * | 7/1979 | Friedman | 206/409 |
| 4,428,645 | A * | 1/1984 | Korbelak et al. | 385/135 |
| 4,846,343 | A * | 7/1989 | Rupert | 206/408 |
| 4,984,685 | A * | 1/1991 | Douglas | 206/408 |
| 7,309,038 | B2 * | 12/2007 | Carroscia | 242/170 |
| 7,325,683 | B2 * | 2/2008 | Bae et al. | 206/397 |
| 7,410,111 | B2 * | 8/2008 | Carroscia | 242/171 |
| 7,650,993 | B2 * | 1/2010 | Bawabe | 206/388 |
| 7,866,586 | B2 * | 1/2011 | Fabian | 242/171 |

* cited by examiner

*Primary Examiner* — Bryon Gehman
(74) *Attorney, Agent, or Firm* — David M. Driscoll, Esq.

(57) ABSTRACT

A bi-directional storage and dispensing system is for accommodating cables, cords, tubes, hoses, and other similar mediums. The system includes a hollow container; a smaller diameter tube positioned within the container; and a pair of covers at either end of the container for holding the tube within the container while being removable.

15 Claims, 9 Drawing Sheets

Fig 2A
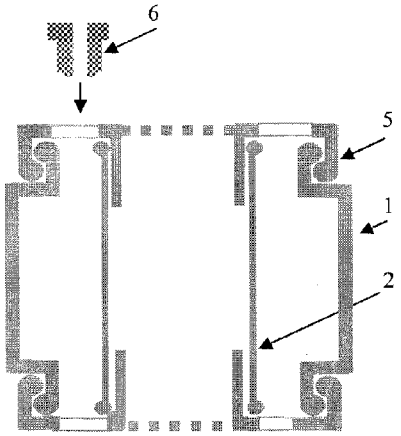
Fig 2B
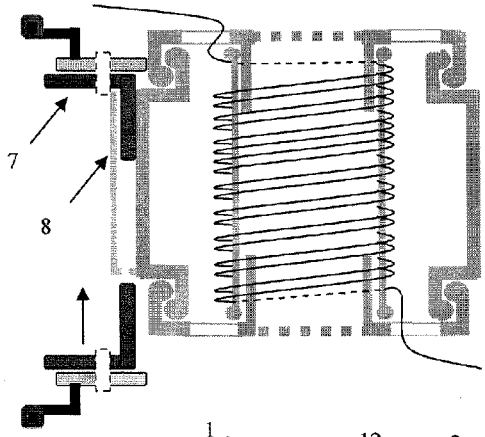
Fig 2C
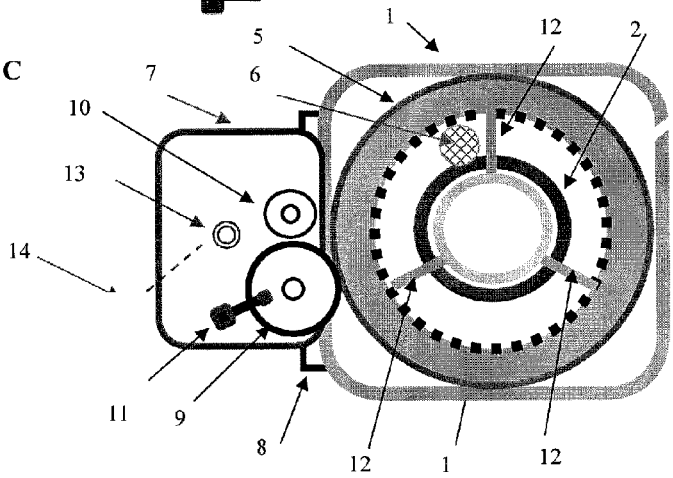
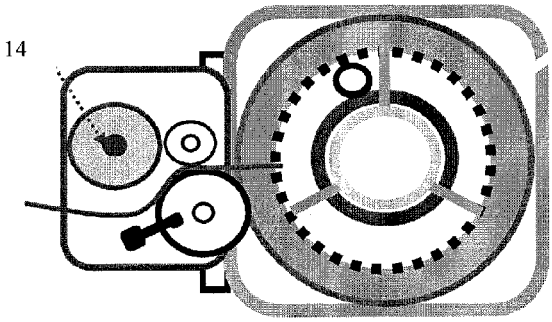
Fig 2D
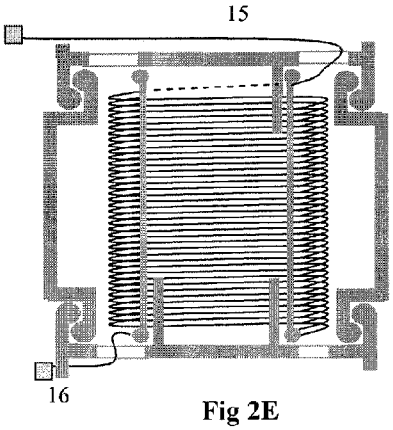
Fig 2E

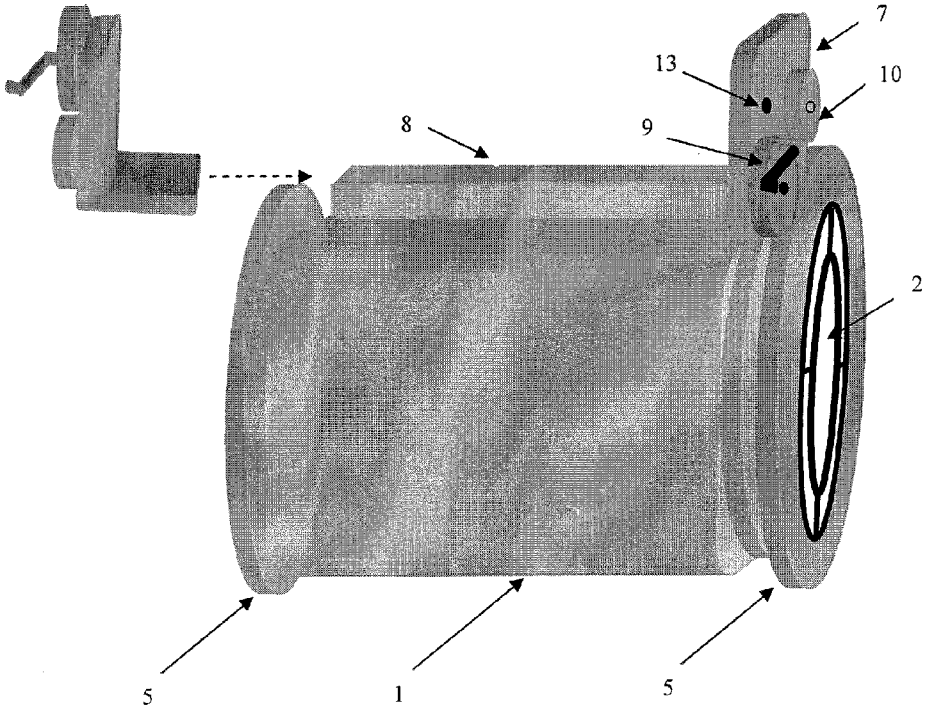
Fig 2F
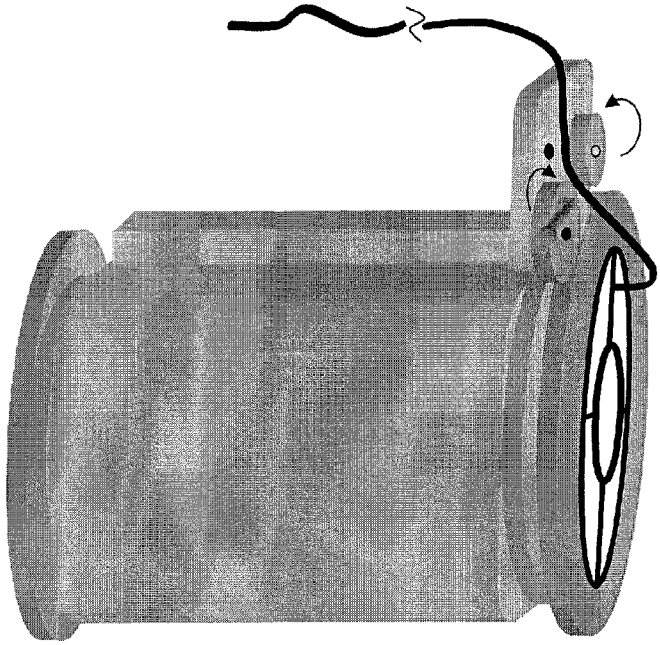

Fig 3A
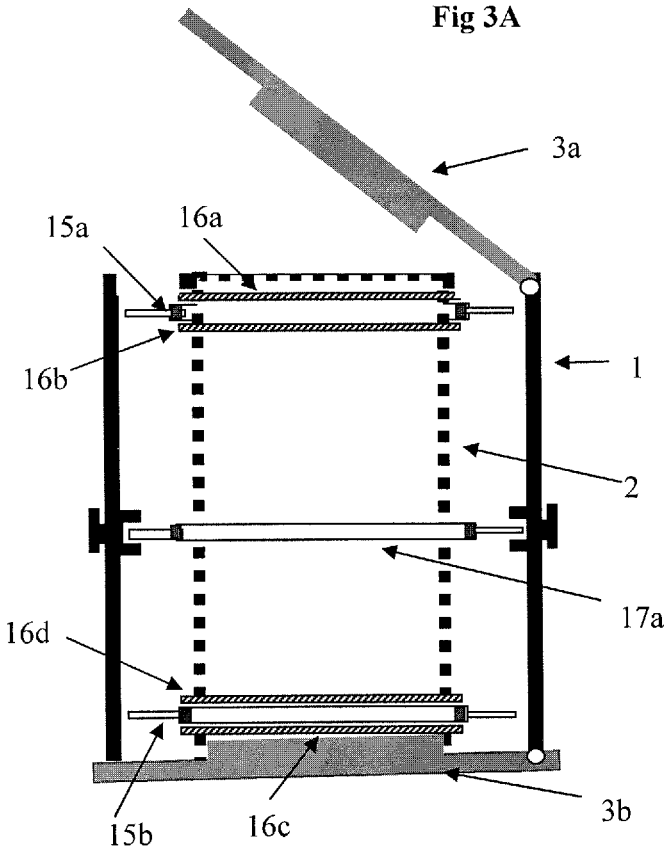
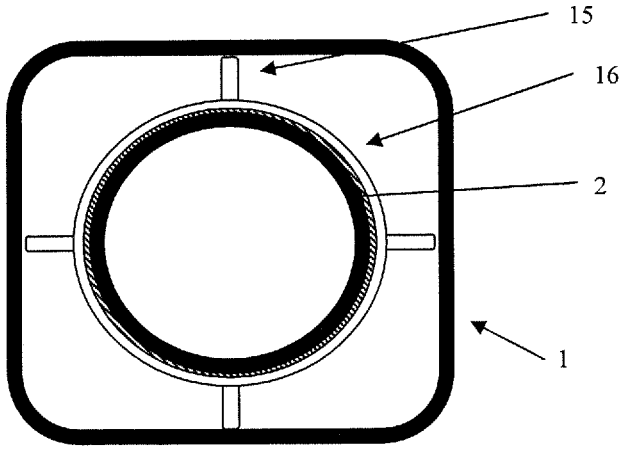
Fig 3B 16d
15b
16c
1

16d
Retaining
Ring for one
side of 15b
15b
Cable Guide
16c
Retaining Ring
for other side of
15b
1
Container
Separator shown
assembled to Tube
17a
2
16b
15a
16a 2
Tube
17a
Separator. Push Fit
Free to move along Tube
16b
Retaining
Ring for other
side of 15a
15a
Cable Guide
16a
Retaining
Ring for
one side of
15a Fig 4 A
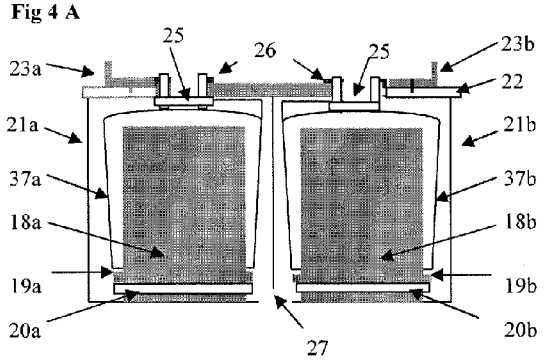
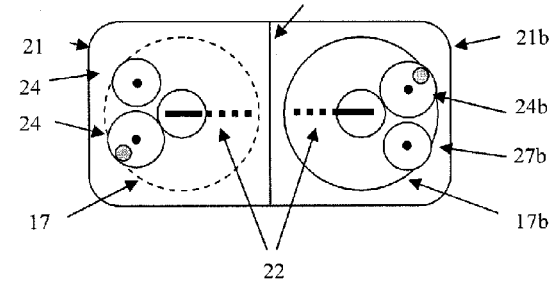
Fig 4 B
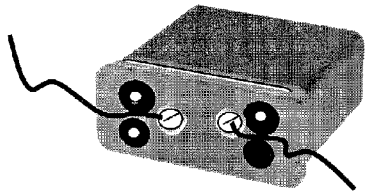
Fig 4 D
Fig 4 C
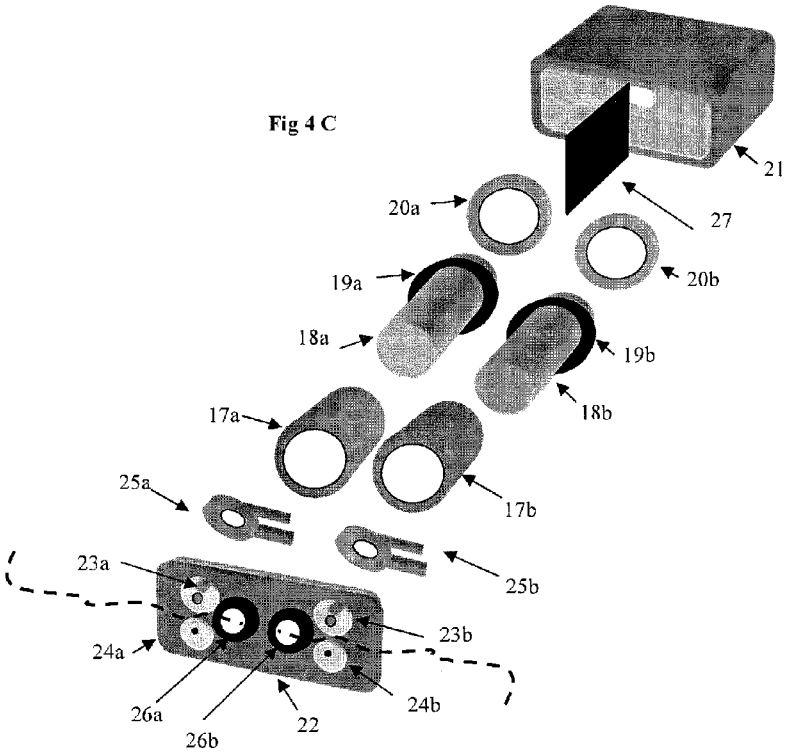

STORAGE AND DISPENSING SYSTEM

RELATED CASES

Priority for this application is hereby claimed under 35 U.S.C. §119(e) to commonly owned and U.S. Provisional Patent Application No. 61/512,479 which was filed on Jul. 28, 2011 and which is incorporated by reference herein in its entirety.

FIELD OF THE INVENTION

The present invention relates to a means of storing and dispensing flexible mediums such as cables, cords, tubes, and hoses and straightening the medium both when being stored and when being dispensed.

BACKGROUND OF THE INVENTION

There are many types of products available for the storage and dispensing of flexible mediums such as cables, cords, tubes, and hoses. However, all these systems have a drawback in that, once stored; only one end of the medium is usefully accessible. For example, an electrical cable has a plug at one end and a socket at the other end. Winding the cable on a reel places one end under multiple windings and results in being able to only access the plug or socket, depending on which is outer-most. It is often necessary only to deploy a short length of cable but the user is forced to unwind the complete cable. Invariably, this leads to a coiled and tangled cable.

Some storage devices have a means of dispensing cable therefrom. However, none of these have the means of dispensing the whole length of the cable. For example, there are spring-loaded extension cables that can be connected to a telephone jack that extend from an end of a housing. However, the cable is not continuous, meaning that each end of the cable can only be drawn for a limited distance, usually half the total length of the cable. There are other devices that have cables coiled around a core. However, the cable can only be extended from one end.

Accordingly, it is an object of the present invention to provide a storing and dispensing system or apparatus that allows for the cable to be stored around the center tube from both ends and also to be dispensed from either end partially or fully.

Some storage devices have a crank attached to a storage reel. This facilitates retrieval but does not straighten the cable.

Accordingly, another object of the present invention is to provide a storing and dispensing system or apparatus that incorporates a means of straightening the cable during the storage and dispensing process.

BRIEF SUMMARY OF THE INVENTION

In accordance with the present invention, the simplest embodiment of the system includes a container that can be of any suitable shape and that is open at both ends with an inner tube with a void between the container and the tube with various methods of supporting the inner tube. This invention allows the cable to be stored on to the inner tube and dispensed from both ends of the container. This allows partial or complete deployment and retrieval of the cable from either end. This invention also encompasses the provision of a means of straightening the cable both during storage and retrieval.

In one embodiment described herein there is provided a system for storing and dispensing cable from both ends of the system comprising: a hollow container; a smaller diameter tube positioned within the container; and a pair of covers at either end of the container for holding the tube within the container while being removable.

In another embodiment of the present invention there is provided a system for storing and dispensing cable from both ends of the system, comprising: a hollow container; a smaller diameter tube positioned within the container; a rotator guide disposed at at least one end of the container and including at least one port through which cable is fed; and a locking mechanism for securing together the container and tube.

In accordance with the present invention there is also provided a system for storing and dispensing cable from both ends of the system, comprising: a hollow container having separate compartments; an opening at the top of each compartment with a collar that rests against a drive pulley; a smaller diameter tube positioned within the container; and a cable guide that is attached to the collar and that rotates as the collar rotates.

BRIEF DESCRIPTION OF THE DRAWING

The invention description below refers to the accompanying drawings, in which:

FIGS. 2A through FIG. 2I describe a second embodiment of the present invention of a bi-directional storage and retrieval device;

FIGS. 3A through FIG. 3E describe a third embodiment of the present invention of a bi-directional storage and retrieval device;

FIGS. 4A through FIG. 4D describe a fourth embodiment of the present invention of a bi-directional storage and retrieval device.

DETAILED DESCRIPTION

Figure 1A:
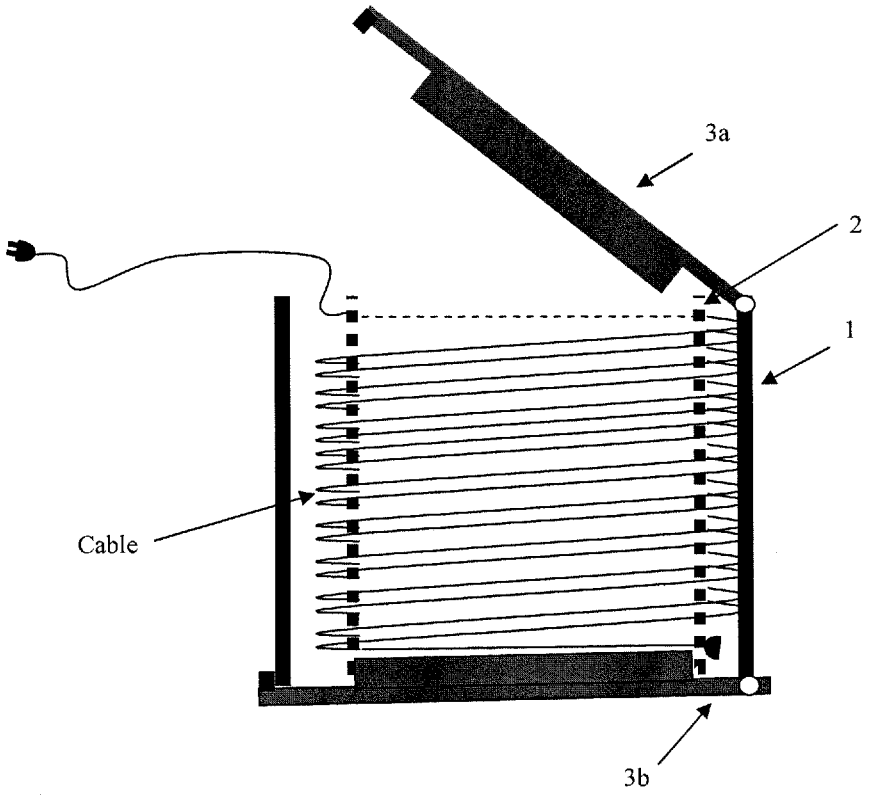
FIGS. 1A through FIG. 1F describe a first embodiment of the present invention of a bi-directional storage and retrieval device.
Figure 1B:
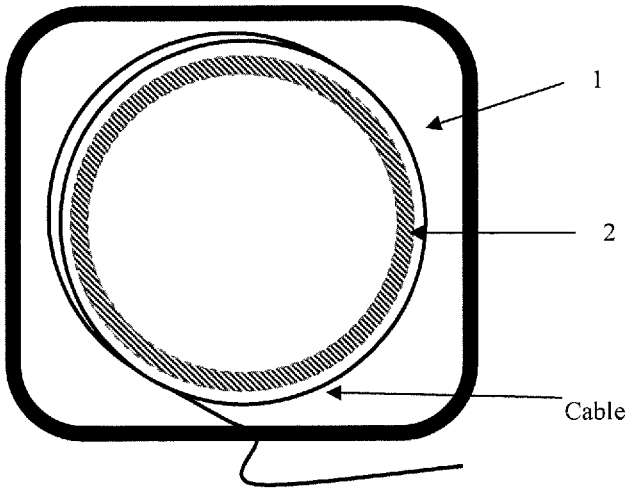

For simplicity in connection with the following descriptions, all flexible mediums are referred to as a cable, but it is understood that the same principles also apply to other flexible products such as, but not limited to, cords, tubes, and hoses. A first embodiment of the present invention is illustrated in FIGS. 1A through 1F. As illustrated in FIGS. 1A and 1B, the bi-directional storage and retrieval system is comprised of a container 1, a tube 2 and retaining lids (3*a*, 3*b*) top and bottom. The reduced diameter center portion of each of the retaining lids push fit into the center of the tube 2 to support and prevent the tube from moving. As shown, the tube 2 is centered and supported within the container 1 and by the retaining lids (3*a*, 3*b*). The cable can be wound around the tube 2 by opening either one of the retaining lids with the retaining lid at the other end closed. For example, with retaining lid 3*a* open (see FIG. 1A) and retaining lid 3*b* closed, the cable can be readily wound around the tube 2. The closed retaining lid prevents the tube 2 from moving or rotating while the cable is being wound. It also prevents the cable at that end from dropping out. Closing the retaining lid 3*a* completes the storage of the cable about the tube 2 and within the container 1.

The cable can be dispensed partially or wholly by opening one retaining lid at a time and deploying the cable. The closed retaining lid prevents the tube 2 from moving or rotating while the cable is being deployed. Once the cable is stored the container can be used with either lid on the bottom. Normally, the top facing lid is opened to dispense the cable, while the bottom positioned lid is closed. However, with the embodiment shown in FIGS. 1A and 1B it is possible that both lids can be opened at the same time so as to dispense from both ends of the container 1 at the same time.

Figure 1C:
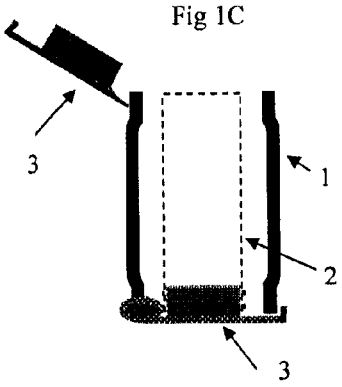
Figure 1D:
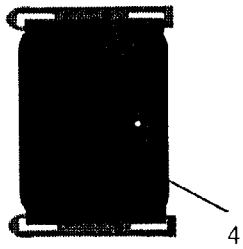
Figure 1E:
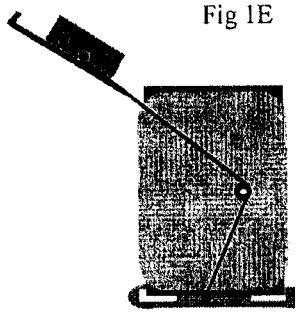
Figure 1F:
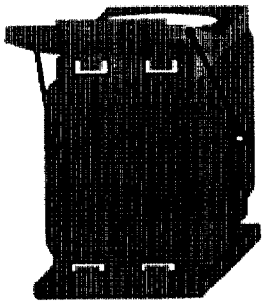

The drawing shown in FIG. 1A illustrates a pair of hinged retaining lids. This embodiment relies on the user to ensure that preferably only one retaining lid is open at a time. FIGS. 1C, 1D, 1E and, 1F shows a bi-stable means of ensuring that only one retaining lid can be opened at a time. FIG. 1D shows the retaining lids connected via a lid closing system that includes an elastic cord 4 that can be stretched to a limited extent such that both retaining lids cannot be opened at the same time. FIGS. 1D-1F illustrate the cord 4 with a center pivot or guide, and with respective ends of the cord attached at a midpoint of the respective lids. Opening a retaining lid extends the elastic cord 4. Extending the cord beyond the hinge causes the lid to snap into the open position. The cord assembly can be protected by means of a cover (not shown) that snaps on to the sides of the container. Refer to FIG. 1D that illustrates the cord 4 with both lids closed, while FIG. 1E illustrates the top lid having been fully opened (beyond the hinge point) to provide a cable force fixing the bottom lid in a closed position. FIG. 1F also illustrates this open top lid position of the lid. Likewise, from the position of FIG. 1D, one can open the bottom lid beyond the hinge point assuring that the top lid remains closed. The material and length of the cable is selected so that both lids cannot be opened to their fully hinged position at the same time.

Figure 2G:
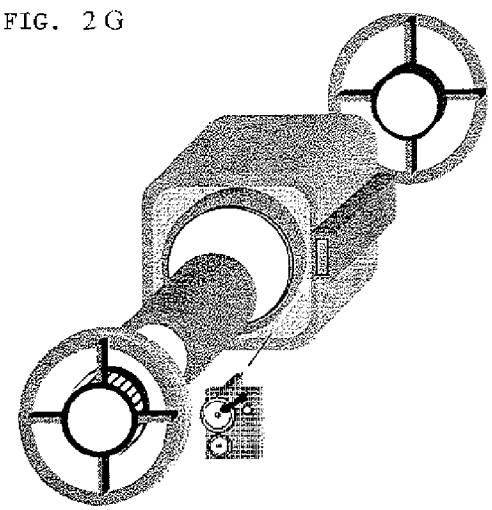
Figure 2I:
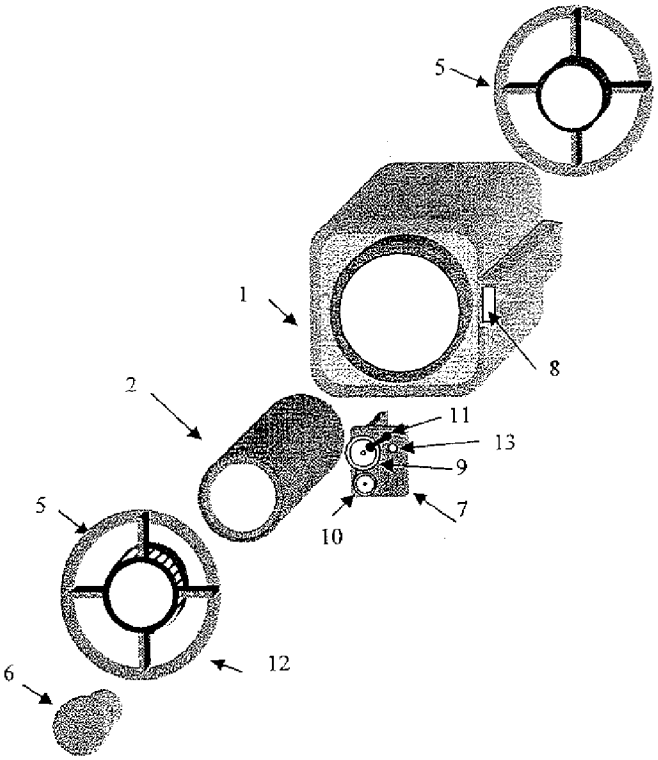
Figure 2I:
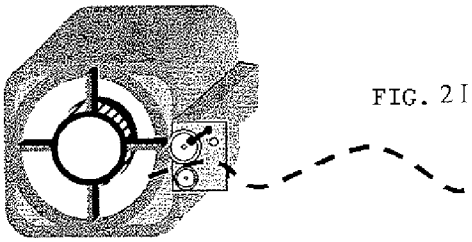
Figure 2H:
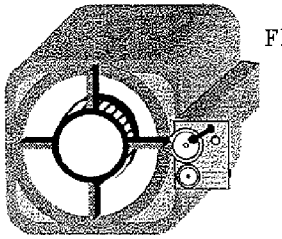

A second embodiment of the present invention is shown in FIGS. 2A through 2I. This embodiment also is comprised of container 1 and the inner tube 2. There are also opposed lid structures illustrated at the top and bottom of the container. In this embodiment the lid structures are shown as a rotator guide 5 retained by the outer lip of the container so that it can rotate around the lip of the container 1. The inner portion of the rotator guide 5 fits loosely within the tube so that it can rotate. The cable can be inserted in any one of the openings between the spindles 12 of the tube 2, and wound around the tube as the rotator guide 5 rotates. The cable can be dispensed by pulling it out of the container. The rotator guide 5 rotates as the cable is pulled. However, it is necessary to ensure that the tube does not rotate with the rotator guide 5. A stopper 6 or other locking means such as a clip that holds the inner tube 2 to the container 1 can be inserted in the space between spindles to lock the tube 2 to the container 1 at opposite ends of the assembly. In FIG. 2A only one of the stoppers is illustrates, but two may be used at opposite ends. As indicated, other means may be employed to fix the tube 2 relative to the container 1.

The cable can also be withdrawn from the opposite end 16 by locking the rotator guide at the other end of the assembly. FIG. 2E illustrates the cable deployed from both ends 15, 16 of the assembly. As explained, the cable can be withdrawn by pulling it out of the container. The cable rotator guide rotates to permit free movement of the cable.

Another feature of the present invention illustrated in this second embodiment incorporates a removable cable feed attachment 7 that includes an assembly with a pulley 9 and pinch wheel 10. A socket 8 is provided to hold the cable feed attachment 7 to the container 1. This allows the cable feed attachment to be located at either end as required. The cable is placed between the pulley 9 and the pinch wheel 10 (refer to FIG. 2F). Rotating the pulley 9 clock-wise advances the cable into the opening between the spindles 12. The pulley 9 also functions as a drive for the rotator guide 5, such as by direct contact drive thereof. In this regard refer to FIG. 2C where contact is illustrated between pulley 9 and the outer edge surface of the rotator guide 5. The cable may be engaged by a spindle 12 and rotated around the tube 2. This arranges the cable around the tube 2. The cable can be deployed by rotating the pulley 9 counter-clock wise or by removing it from between the pulley 9 and the pinch wheel 10 and pulling it out manually. The benefit of storing and deploying the cable by means of the cable feed attachment 7 is that it straightens the cable as it is forced between the pulley 9 and the pinch wheel 10.

The cable feed attachment 7 has a bushing 13. An electric drill (not shown) with a driver attachment 14 can be inserted into the bushing 13. The driver attachment 14 can be used to automatically drive the pinch wheel 10 clockwise to deploy the cable and counter-clockwise to retrieve the cable.

Figures 3C, 3D, 3E:
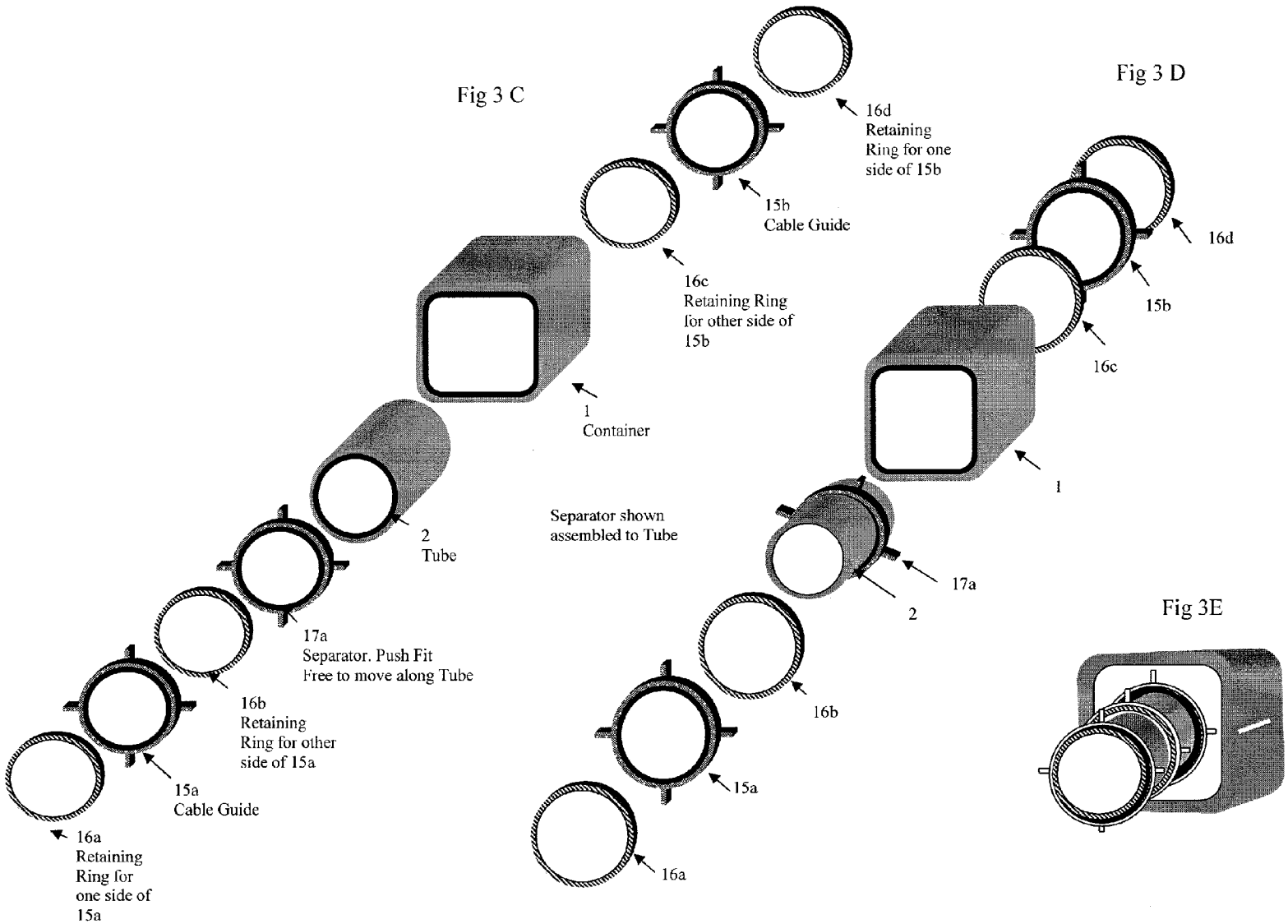

A further embodiment of the invention is illustrated in FIGS. 3A through 3D. The assembly is comprised of the container 1, tube 2, cable guides 15*a*, 15*b*, retaining collars (16*a*, 16*b* and 16*c*, 16*d*) and separator 17*a*. Refer to the exploded views of FIGS. 3C and 3D. The cable guides (15*a*, 15*b*) are held in place by retaining collars (16*a*, 16*b* and 16*c*, 16*d*) at the respective top and bottom of the tube 2. The separator 17*a* is free to move along and rotate with the tube 2. The tube 2 is held in place by retaining lids (3*a*, 3*b*). One end of the cable is initially passed between the spindles of the top cable guide (15*a*), between the spindles of the separator 17, and out between the spindles of the lower cable guide (15*b*). In that way both ends of the cable, such as the plug and socket, are available from opposite ends of the container. The cable can then be stored by winding it into the space between the spindles. For example, pushing the cable into the container from the top causes the top cable guide (15*a*) to rotate and wind the cable around the fixed position tube 2. The bottom retaining lid (3*b*) is closed to prevent the tube from moving. The separator 17*a* prevents the cable from dropping to the other end. The cable can be dispensed by pulling it out of the container 1 from either end. FIGS. 3C, 3D are exploded views of the assembly. FIG. 3E is a three dimensional rendition of the assembly.

The container 1, tube 2 and all moving parts of the assembly are fabricated using very low coefficient of friction material such as polypropylene, polyethylene, nylon, teflon, delrin, or other material with low surface friction. While the invention shows surface to surface contact of the various components, it is expected that moving parts could also have ball or roller bearings to further reduce friction. For example, in the second embodiment described herein the rotator guide 5 can have ball bearings where it comes into contact with the container 1 and tube 2.

Reference is now made to a fourth embodiment of the present invention illustrated in FIGS. 4A through 4D. This embodiment shows a container 21 that has two compartments (21*a*, 21*b*) with a separator wall 27 between the compartments. The compartments may be similar or differ in shape and dimensions. Tapered inserts (37*a*, 37*b*) rest on retainers (19*a*, 19*b*) of supports (18*a*, 18*b*). The tapered inserts have a ratchet arrangement such that they only rotate when the cable is dispensed. Collars (20*a*, 20*b*) are located below the retainers (19*a*, 19*b*) and are free to rotate. The cover 22 fits over the container 21. The pulleys (23*a*, 23*b*) and pinch wheels (24*a*, 24*b*) located on the cover provide a guide for the cables for each side. FIG. 4C shows the cable extending between respective pulleys and pinch wheels. Collars (26*a*, 26*b*) are located on the lid above each of the tapered inserts (17*a*, 17*b*). The collars are in contact with the pulleys (23*a*, 23*b*) and are free to rotate when the pulley is rotated. Cable guides (25*a*, 25*b*) assemble to the underside of the collars (26*a*, 26*b*). The collars are in contact with the pulleys and rotate when the pulleys rotate.

The cable is initially installed by routing it between the pulley 23*a* and pinch wheel 24*a*, the center of the collar 26*a*, the cable guide 25*a*, around the collars (20*a*, 20*b*) into the second container and up to the wire guide 25*b*, collar 26*b* and between pulley 23*b* and pinch wheel 24*b*.

Refer to FIG. 4D that shows the cable ends through the respective collars.

The description below is for one compartment 21*a* but also applies to the second compartment 21*b*. The cable is stored in a container as follows: The cable is fed between the pulley 23*a*, the pinch wheel 24*a*, and through the center of the collar 26*a*. The cable is guided to the rim of the tapered insert 37*a*. Rotating the pulley forces the cable into the collar 26*a* and via the cable guide 25*a* to the rim of the insert 37*a*. The wire guide 25*a* rotates and arranges the cable around the insert 37*a*. Because the insert 37*a* is tapered, the cable falls to the bottom of the compartment.

Dispensing the cable can be accomplished either by pulling the cable out or rotating the pulley (23*a*, 23*b*). The wire guide rotates as the cable is dispensed. When all the cable in one compartment has been dispensed, cable from the other compartment is pulled via the rotating collar. As the cable is withdrawn from the second compartment, it uncoils loosely one rotation at a time to the bottom as the insert is tapered. This prevents the cable from seizing. The cable can also be dispensed by removing it from between the pulley and pinch wheel and dispensing it from the container manually. The cable guide rotates to allow for a smooth withdrawal.

Figure 5:
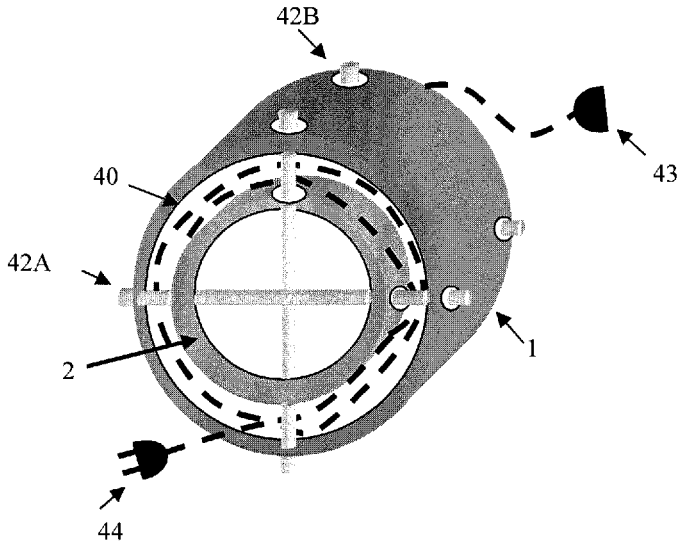
FIG. 5 is a schematic view of a most simple version of the present invention.

Refer also to the simple schematic view of FIG. 5 illustrating a container 1 and an inner tube 2. In this embodiment there is no cable guide. Instead, the coil of cable at 40 is simply coiled by hand into the container. There are two sets of support members shown at 42A and 42B disposed at opposite ends of the container and functioning as a rest surface for the cable coil. FIG. 5 also schematically illustrates typical cable ends by plug 43 and socket 44. When the cable coil 40 is manually coiled into the container from the top through the support member 42A, it falls to the bottom and rests upon the other support member 42B. Each of the support member sets may be in the form of a plurality of removable rods or dowels. If one wishes to withdraw the socket end 44 then member set 42B may be removed providing access to the inside of the container and enabling the user to withdraw the cable from that end. In that case the container may be inverted to withdraw cable from the socket end 44. In this embodiment the removable element is each support member set.

This invention can also be used, as described above, in health care facilities such as hospitals, rehabilitation centers, nursing homes, etc. The use of this device can be further enhanced by placing an antibacterial liquid within the container, or passing the cable/tube through the opening that has a disposable anti-bacterial pad or other means of wiping the cable/tube as it passes through.

What is claimed is:

1. A system for storing and dispensing cable from both ends of the system comprising:

a hollow container having top and bottom ends;

an inner tube coaxially positioned within the container;

a pair of covers disposed respectively at top and bottom ends of the container for holding the tube within the container;

a pair of rotator guides disposed respectively adjacent top and bottom ends of the container mounted between the container and tube and constructed and arranged for rotation relative to both the container and inner tube.

2. The system of claim 1 wherein each cover comprises a lid that is hinged to the container.

3. The system of claim 1 wherein the covers each have open and locked positions, and wherein each cover engages with and locks the tube against rotation relative to the cover when in a locked position.

4. The system of claim 1 wherein each cover comprises a lid having a center ledge that interlocks with a tube end for locking the tube against rotation relative to the lid.

5. The system of claim 1 a separator wall, said container having a longitudinal axis extending between top and bottom ends thereof, and said separator wall extending transverse to said longitudinal axis so as to separate the container into upper and lower container chambers.

6. The system of claim 1 wherein either cover is operable to an open position for storing and dispensing cable from both ends of the assembly.

7. A system of claim 1 including a separator that divides the container into two compartments such that there is access between the two compartments.

8. A system for storing and dispensing cable from both ends of the system comprising:

a hollow container having top and bottom ends;

an inner tube coaxially positioned within the container;

a pair of covers disposed respectively at top and bottom ends of the container for holding the tube within the container;

cable guides, one at each end of the container that are free to rotate relative to the container, each said cable guide providing support between the container and inner tube;

wherein each cable guide includes a guide and a pair of retaining collars for supporting the guide.

9. The system of claim 8 wherein the tube has a top and a bottom, and the guides are held in place by the retaining collars at the respective top and bottom of the tube.

10. A system for storing and dispensing cable from both ends of the system comprising:

a hollow container having top and bottom ends;

an inner tube coaxially positioned within the container;

a pair of covers disposed respectively at top and bottom ends of the container for holding the tube within the container;

cable guides, one at each end of the container that are free to rotate relative to the container, each said cable guide providing support between the container and inner tube;

and a removable lock member for preventing movement between the container and tube.

11. A system for storing and dispensing cable from both ends of the system, comprising:

a hollow container having top and bottom ends;

an inner tube positioned within the container, a rotator guide disposed at at least one end of the container and including at least one port through which cable is fed;

a locking mechanism for securing together the container and tube; and wherein a respective rotator guide is disposed at each of a top end and a bottom end of the container.

12. The system of claim 11 wherein the rotator guide is rotatable relative to the container and tube.

13. The system of claim 12 including a pair of retaining collars for holding each rotator guide to the tube.

14. The system of claim 3 including a separator arranged along the tube.

15. The system of claim 14 wherein each of the rotator guides and separator has radially arranged spindles.

* * * * *